US006149555A

United States Patent [19]

Kinback

[11] Patent Number: 6,149,555

[45] Date of Patent: Nov. 21, 2000

[54] VARIABLE WEIGHT EXERCISE BAG

[75] Inventor: Steven Robert Kinback, Phoenixville, Pa.

[73] Assignee: Steven R. Kinbeck, Phoenixville, Pa.

[21] Appl. No.: 09/368,627

[22] Filed: Aug. 5, 1999

[51] Int. Cl.[7] ..... A63B 21/06

[52] U.S. Cl. ..... 482/93; 482/105

[58] Field of Search ..... 481/105, 93; 16/119; 482/93, 105–109; 383/7, 9, 10, 61

[56] References Cited

U.S. PATENT DOCUMENTS

| | | | |
|---|---|---|---|
| D. 368,125 | 3/1996 | Wiseman . | |
| D. 388,481 | 12/1997 | Ashcraft et al. | D21/690 |
| 1,577,077 | 3/1926 | Ray . | |
| 3,278,184 | 10/1966 | Rosenbaum . | |
| 3,910,577 | 10/1975 | Boyle . | |
| 4,103,887 | 8/1978 | Shoofler | 482/106 |
| 4,199,140 | 4/1980 | Ferretti . | |
| 4,332,379 | 6/1982 | Bannister | 482/105 |
| 4,357,009 | 11/1982 | Baker . | |
| 4,382,302 | 5/1983 | Watson . | |
| 4,394,012 | 7/1983 | Egbert . | |
| 4,673,179 | 6/1987 | Pengler | 482/93 |
| 4,695,051 | 9/1987 | Jenison | 482/108 |
| 4,989,267 | 2/1991 | Watson . | |
| 5,085,320 | 2/1992 | Scott . | |
| 5,167,602 | 12/1992 | Lehktman . | |
| 5,233,779 | 8/1993 | Shaw | 42/94 |
| 5,242,348 | 9/1993 | Bates | 482/105 |
| 5,347,671 | 9/1994 | Hunts . | |
| 5,417,635 | 5/1995 | Sell | 482/105 |
| 5,560,683 | 10/1996 | Teixeira | 16/119 |
| 5,584,599 | 12/1996 | Knitter | 405/15 |
| 5,725,458 | 3/1998 | Newman | 482/87 |

*Primary Examiner*—John Mulcahy
*Attorney, Agent, or Firm*—Volpe and Koenig, P.C.

[57] ABSTRACT

A variable weight exercise bag to be used by a person for weight lifting and physical fitness. The device includes a flexible main compartment with a resealable opening and convenient handles. The device is designed to hold weight bearing materials which provide the resistance required for physical exercise. The size, shape and materials of construction of the device make it suitable for a wide variety of aerobic and strength training exercises. When the device is empty it is very light and occupies minimal space.

7 Claims, 5 Drawing Sheets

VARIABLE WEIGHT EXERCISE BAG

BACKGROUND OF THE INVENTION

The present invention relates to equipment used for physical fitness, exercise, physical rehabilitation and in particular to weight lifting.

BRIEF DESCRIPTION OF PRIOR ART

There are many different types of equipment and apparatus used by people to exercise. Free weights, plate loaded machines, elastic bands and steel rods are all examples of equipment typically used to provide resistence for exercising and muscle building. Stepping machines, stationary bicycles, treadmills, skiing machines and rowing machines are examples of equipment used for aerobic training and sport specific training. Most of this equipment is typically not portable and must be used in the home or at a YMCA, commercial gym, health club or school.

Many different weight lifting and exercise devices utilize sand or other similar materials to provide weight for resistence, however these products are filled with the sand or other material at the point of manufacture and are sewn or sealed shut and then shipped to the user. The end user pays for the weight bearing material and the shipping charges. The user is then also limited to exercising with the fixed weight of the material provided by the manufacturer.

Sandbags have been used in construction applications for many years. The common sandbag is designed for one time use and is completely open at one end. When filled with sand it is tied shut with string. The resulting product has a gathering of loose material at the tied end which can be used as a handle. This design is fine for construction applications but is awkward to handle if lifted repeatedly. In addition the tied closure is not reliable and will often leak.

There are other exercising devices incorporating a bag in some shape or form which can be filled with a weighted material and have handles or a harness for carrying the bag on a persons back or over the shoulder. Such devices are disclosed in U.S. Pat. No. 4,332,379 ( Bannister ) and U.S. Pat. No. 5,417,635 ( Sell ). These devices are not designed for performing multiple weight lifting exercises but for walking or running with added resistance.

Other devices exist which are bags having straps or a harness for attaching the bag to a specific limb such as an ankle or wrist. Weighted material is placed in the bag to provide resistance. Such a device is disclosed in U.S. Pat. No. 3,910,577 ( Boyle ). This device is intended to be used by one arm or leg at a time and is only able to hold a limited amount of weight.

Medicine balls and other weighted balls can be used to perform a variety of weight lifting exercises. These products do not have resealable openings to allow the weight of the ball to be altered and they do not have handles which make the weight easier to hold and balance when performing an exercise.

OBJECTS AND ADVANTAGES

Accordingly several objects and advantages of my invention are: 1) The resealable opening which provides the user the convenience of being able to change the weight of the device as desired and the ability to empty the bag making it convenient to travel with. This feature also saves the user the cost of shipping that is associated the with weight and bulk of many other products. 2) The invention is capable of holding a considerable amount of weight, making it useful to a variety of people having different strength and abilities. 3) The invention can be filled with a wide variety of materials providing the user the flexibility to use the invention in different ways, depending on the weight of the material it is filled wit. 4) The invention has handles which make it easy to use in performing a wide variety of weight lifting exercises with the entire body. It can be used for aerobic training, strength training, physical therapy and rehabilitation.The invention can be used as a primary fitness apparatus or as a supplement to any of the other numerous fitness devices and programs.

SUMMARY OF THE INVENTION

The invention is a device for exercising and weight lifting. The invention is roughly the size of a small bed pillow which has handles and a resealable opening through which the user can fill or empty the contents of the bag. The weight or resistance of the bag can be varied depending on the density and amount of material placed into it. Many of the materials that can be put into the bag are common inexpensive items that are readily available or found in most households, such as sand, salt or seed. The invention can be used to perform exercises with all parts of the body, for example: lifting straight over head, lift while lying on your back, squat with the bag placed over your shoulders, bent or upright rowing, arm and leg curls, arm and leg extensions and sit up with the bag placed across your chest.

DESCRIPTION OF THE INVENTION AND VARIATIONS THEREOF

A portable, mufti functional, variable weight exercising device as shown in FIGS. 1 thru 7 composed of a bag 20 manufactured from flexible sheet material. The bag 20 can be made of heavy duty material such as 16 to 20 mil vinyl, PVC, canvas, rubber, nylon or similar material.

The components of the bag 20 being made from flexible material can be sewn together or fastened with adhesives of sufficient strength and durability to withstand weight in excess of 75 pounds.

Figure 1:
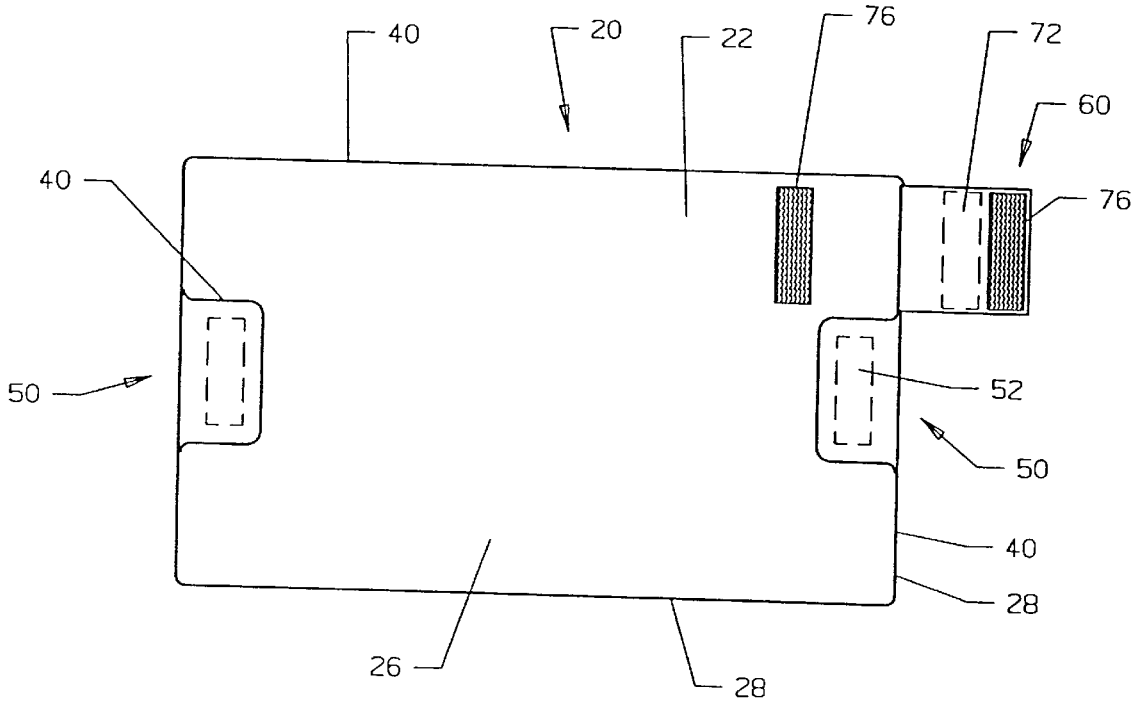
FIG. 1. A plan view of the invention.
Figure 2:
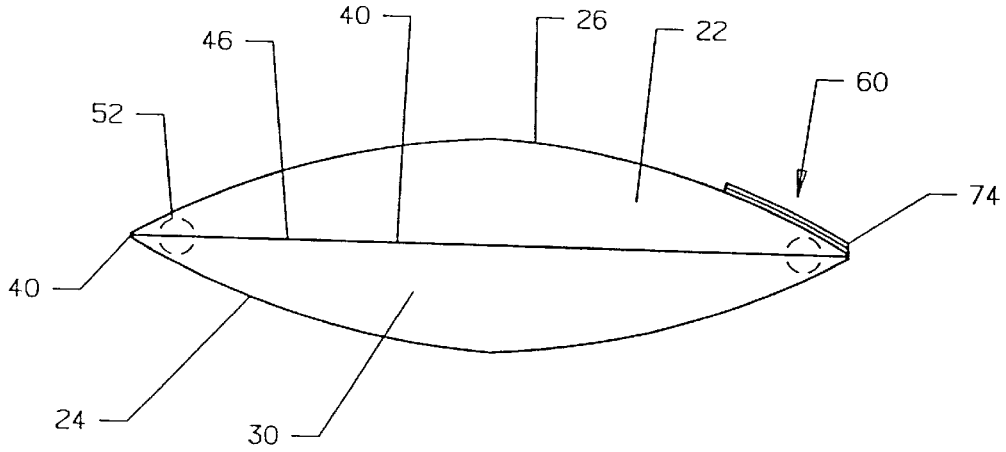
FIG. 2. A side view of the invention.

Referring to FIG. 1 the bag 20 includes a generally rectangular main compartment 22 with two or more handles 50 and a fill tube 60. The main compartment 22 is formed by a front panel 24 and a back panel 26 which are joined together along the four edges 28 by stitching 40 or other suitable means. A void 30 is created by the joining of the two panels 24, 26 forming the main compartment 22. The bag 20 can be manufactured in several sizes to accommodate various amounts of a weight bearing material 32 as shown in FIG. 4.

The bag 20 shall have two or more handles 50. The preferred embodiment depicted in FIG. 1 having two handles 50 which are located at opposing ends of the bag 20.

The handles 50 shall be formed by a grip 52 made of PVC, plastic or cardboard tubing, hose or similar pliable material which is positioned at the end of the bag 20 between the front and back panels 24,26. The grip 52 is secured in place by stitching or adhesive 40 which join the front and back panels 24, 26 together immediately around the periphery of the grip 52 thus forming the handle 50. Different embodiments as shown in FIG. 7 may include a cut out adjacent to the grip 52 through which the users fingers can be inserted.

Figure 4:
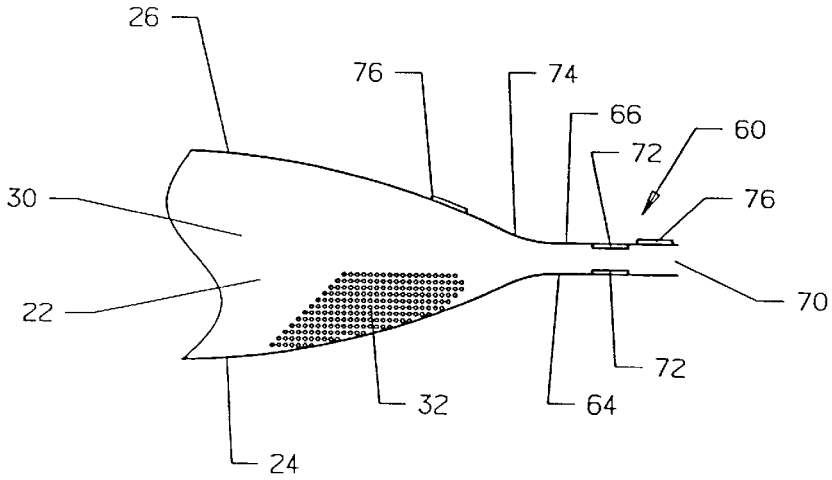
FIG. 4. A cross section and detail of the fill tube and resealable opening.
Figure 5:
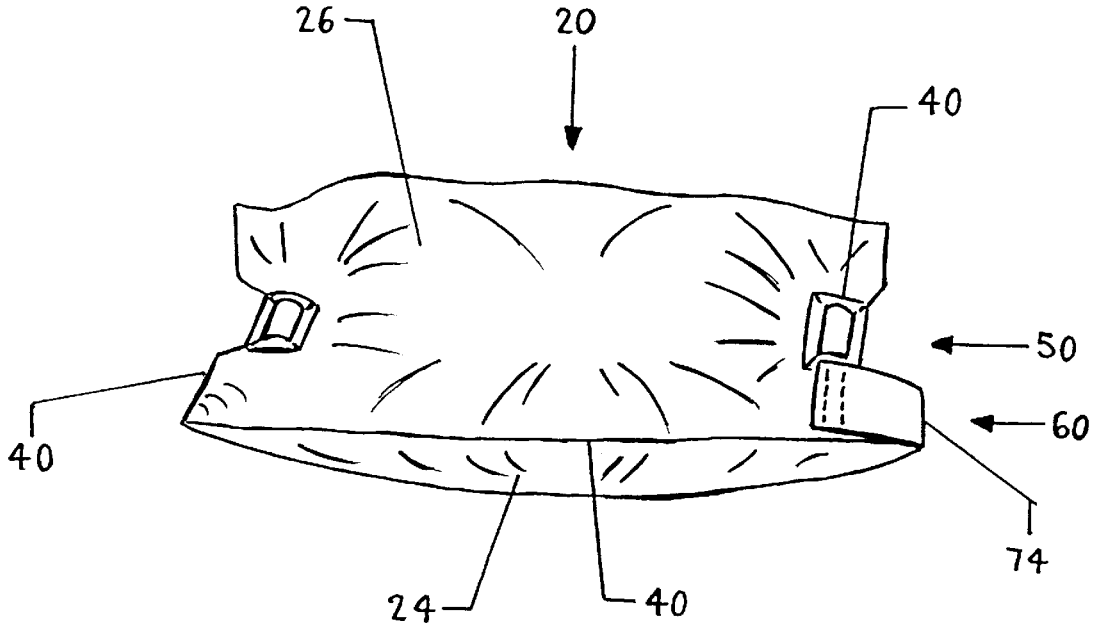
FIG. 5. A perspective view of the invention.
Figure 6:
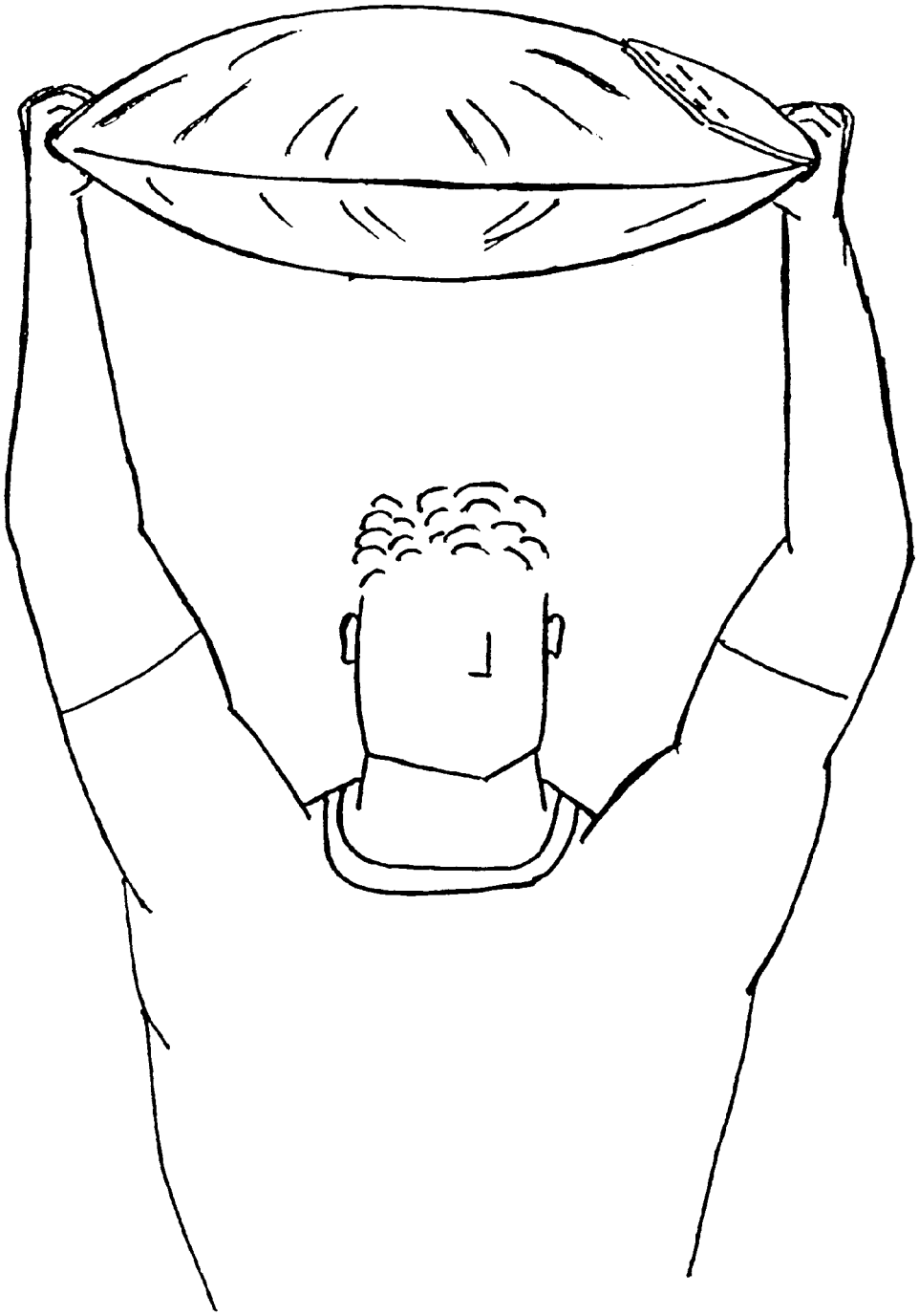
FIG. 6. A picture of the invention being used to perform an exercise.

The bag 20 shall have a fill tube 60 as detailed in FIG. 4 for the purpose of changing, filling or emptying the weight bearing material 32 from the bag 20. The fill tube 60 is made from and is an extension of the same piece of material which the front and back panels 24, 26 are made. Thus as shown in FIG. 4 the fill tube 60 is comprised of a front fill tube panel 64 and a back fill tube panel 66. As with the main compartment 22, two of the edges of the front and back fill tube panels 64, 66 are joined together by stitching. The edge of the fill tube 60 which meets the edge of the main compartment 22 is left unsewn, creating an opening into the main compartment 22. Similarly the opposite edge of the fill tube 60 is also open thus forming a pathway thru which the bag 20 can be filled or emptied. A resealable opening 70 is formed by attaching a closing device 72, such as hook and loop material on to the interior side of the front and back fill tube panels 64,66 so that the opening can be selectively closed or opened.

Figure 3:
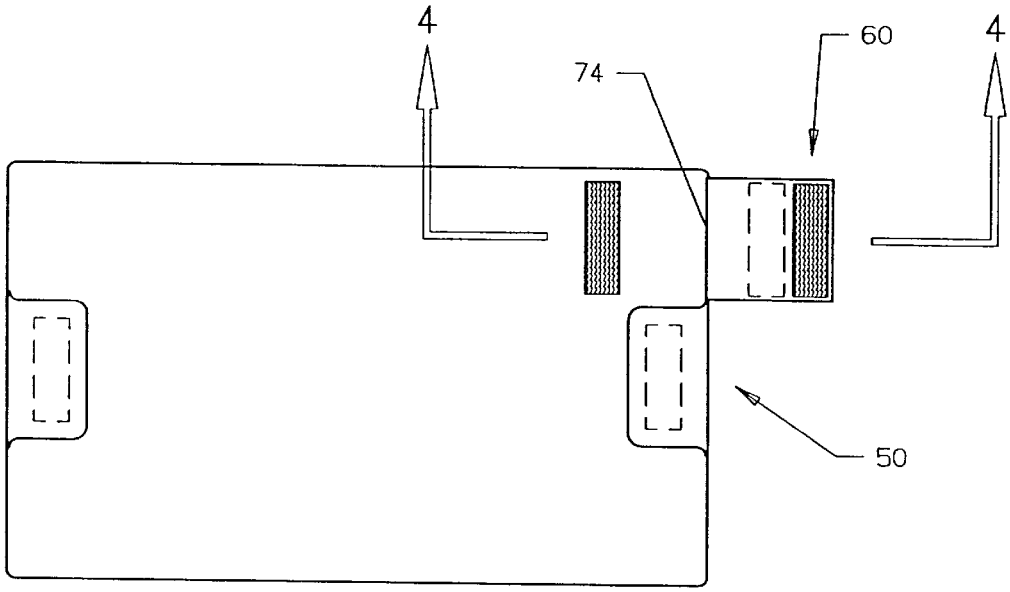
FIG. 3. A cross sectional reference for FIG. 4.

The preferred embodiment will have the fill tube 60 located on one of the short sides of a rectangular bag 20 at a position above or below the handle 50, however different versions may be constructed with the fill tube 60 being located along one of the long sides of the bag 20. To reinforce the closure of the bag 20 a secondary closing device 76 is used. The fill tube 60 can be folded over. FIG. 3 depicts a fold 74 along the edge where the main compartment 22 and fill tube 60 are joined. Opposing pieces of hook and loop material or similar device are used to secure this secondary closure 76. One piece of hook and loop being fastened on the outside of the fill tube 60 and another piece of hook and loop material is attached to the outside of the main compartment 20 such that when the fill tube 60 is folded over the two pieces of hook and loop material come together.

Figure 7:
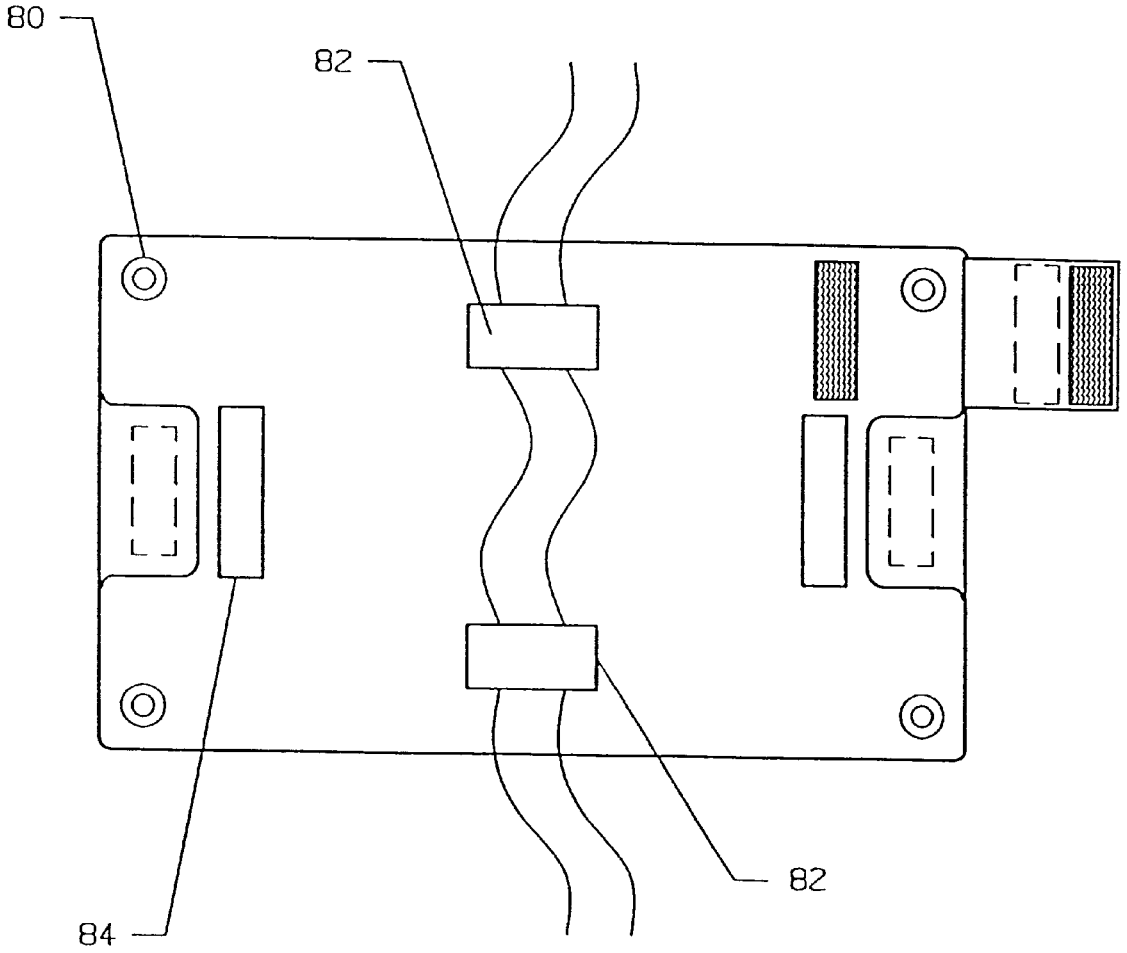
FIG. 7. A plan view showing possible variations of the invention.

Different embodiments of the bag 20 can be manufactured which include grommets 80, belt loops 82 or cut outs 84 as shown in FIG. 7. These fixtures can be used to attach a belt or harness to enable the user alternate methods of lifting or carrying the bag 20. Another variation of the invention entails use of a water tight bladder, slightly smaller than the bag 20. The bladder is inserted into the bag 20 thru the fill tube 60. The bladder is then filled with water or other liquid and sealed. The resealable opening 72 is then closed and the bag 20 can be used as desired.

The previous description is representative of the invention. There are various modifications and applications of the invention that can be made without changing the intention of the invention.

To fill the bag 20, weight bearing material 32 such as sand, dirt, seed, cement, or flour is poured or scooped into the bag 20 thru the resealable opening 72 and the fill tube 60. The resealable opening 72 is then closed, folded over and secured in place by the secondary closure 76.

To operate the bag 20, the user can pick up the bag 20 by the handles 50. Physical exercises are performed by repeatedly lifting the bag 20 with the arms, legs, back, abdominals, shoulders, neck or chest. The bag 20 can be placed across the users back, shoulders, chest or legs without being held by the hands in order to perform different exercises. Depending on the number of exercises performed and the rate at which they are performed the bag 20 can be used for aerobic conditioning or for strength training. The bag 20 can also be used as resistance for performing specialized exercises and conditioning drills that are sport specific or required for rehabilitation of an injured or weak muscle or joint.

When a given exercise session is completed the bag 20 can be conveniently stored while containing the weight bearing material 32. Should the user wish to travel with the bag 20, the weight bearing material 32 can be removed and the bag 20 can be rolled or folded into a relatively small and very light weight package.

The variable weight exercise bag 20 provides a convenient, versatile, economical and effective means for exercising and weight training for people of all ages and athletic abilities.

While the above description contains specifications, these should not limit the scope of the invention as there may be other variations possible, such as the inclusion of additional handles 50 on the bag 20 or fixtures for attaching a harness.

Drawing Reference Numerals

Part Name
20 bag
22 main compartment
24 front panel
26 back panel
28 edge
30 void
32 weight bearing material
40 stitching
50 handles
52 grip
60 fill tube
64*f* ront fill tube panel
66 back fill tube panel
70 resealable opening
72 closing device ( hook and loop material)
74 fold
76 secondary closing device ( hook and loop material)
80 grommet
82 belt loop
84 cut out

What is claimed is:

1. A portable multi-purpose exercise device comprising:

an elongate bag formed from a pair of panels joined at their edges to form an internal cavity, said cavity being adapted for containing a weight bearing material, said bag defining a perimeter;

two handles located at opposite ends of said bag; said handles being formed by elongate grips sandwiched and secured between said panels of said bag, parallel to and adjacent said perimeter; and, a resealable closure continuous to said bag, said closure having at least one fastener; whereby the closure is in a first open position with said fastener disengaged to receive and discharge weight bearing material, and is in a second closed position with said fastener engaged to contain said weight bearing material.

2. The device as defined in claim 1, wherein said closure further includes a spout for receiving and discharging said weight bearing material; whereby the closure is in a first open position with said fastener disengaged and said spout extended to receive and discharge weight bearing material, and is in a second closed position with said fastener engaged and said spout retracted to contain said weight bearing material.

3. The device as defined in claim 1, further including a secondary closure comprising a spout and two complimentary fasteners; whereby said spout is folded over and secured to said bag using said complimentary fasteners; the first of said complimentary fasteners being located upon said spout, and the second of said complimentary fasteners being located upon said bag, such that when said complimentary fasteners are joined, said spout is secured to said bag.

4. The device as defined in claim 3 wherein said weight bearing material is a liquid.

5. The device as defined in claim 1 wherein said weight bearing material is a solid flowable material.

6. The device as defined in claim 1 further comprising a waterproof bladder located within said cavity.

7. The device as defined in claim 1, wherein each said handle further includes a cutout for facilitating the insertion of at least one finger.

* * * * *